United States Patent [19]
Hetrick
[11] 4,238,895
[45] Dec. 16, 1980

[54] LIFT ARM WITH IMPROVED CHAIN CONNECTOR

[75] Inventor: Vernon L. Hetrick, Fairview Park, Ohio

[73] Assignee: Meyer Products, Inc., Cleveland, Ohio

[21] Appl. No.: 30,283

[22] Filed: Apr. 16, 1979

[51] Int. Cl.³ ..... E01H 5/00
[52] U.S. Cl. ..... 37/41; 24/116 R
[58] Field of Search ..... 37/41, 42, 50; 172/452, 172/502, 293, 393; 24/116 R; 254/45–47; 280/457

[56] References Cited

U.S. PATENT DOCUMENTS

| | | | |
|---|---|---|---|
| 1,633,020 | 6/1927 | Ingram | 24/116 R |
| 1,709,244 | 4/1929 | Abbe | 24/116 R |
| 2,775,176 | 12/1956 | Gibson | 172/502 X |
| 2,978,767 | 4/1961 | Goss | 24/116 R |
| 3,125,355 | 3/1964 | Snuggins | 280/457 |
| 3,127,873 | 4/1964 | Guillavme et al. | 24/116 R X |
| 3,252,716 | 5/1966 | Gaterman | 37/41 |
| 3,465,456 | 9/1969 | Meyer | 37/50 |
| 3,665,562 | 5/1972 | Gower et al. | 24/116 R |
| 4,027,989 | 6/1977 | Pierce | 24/116 R X |
| 4,176,874 | 12/1979 | Archer | 24/116 R X |

FOREIGN PATENT DOCUMENTS

| | | | |
|---|---|---|---|
| 313704 | 8/1969 | Sweden | 24/116 R |

*Primary Examiner*—E. H. Eickholt
*Attorney, Agent, or Firm*—Meyer, Tilberry & Body

[57] ABSTRACT

An improved lift arm is pivoted upward by a hydraulic cylinder to lift a plow blade by a chain connected between the lift arm and blade. The lift arm includes an elongated body with a chain receiving member permanently fixed to an end thereof. Engaging a link of the chain is a slot in an upwardly facing concave surface of the chain receiving member. The slot has a width slightly greater than the thickness of a link of the chain so that a link is engaged and restrained. An opening, having a width slightly greater than the width of the link, receives the chain ahead of the link restrained in the slot. Regardless of the relative orientation of the chain and lift arm, the concave surface causes the chain and chain receiving member to remain generally perpendicular.

3 Claims, 6 Drawing Figures

FIG. 1
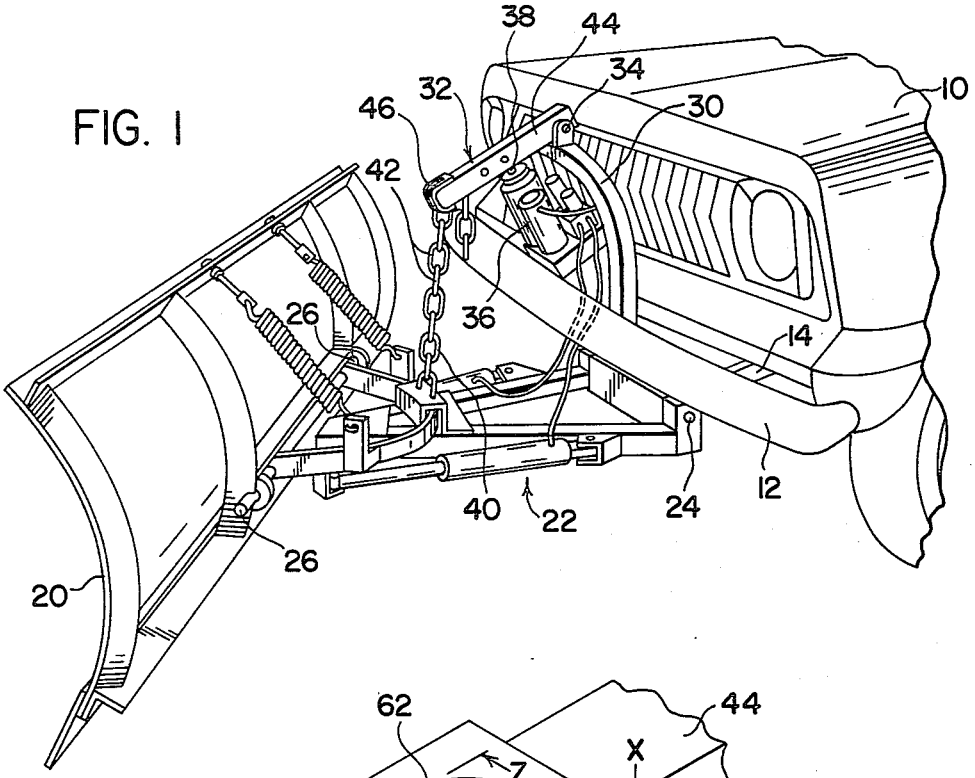
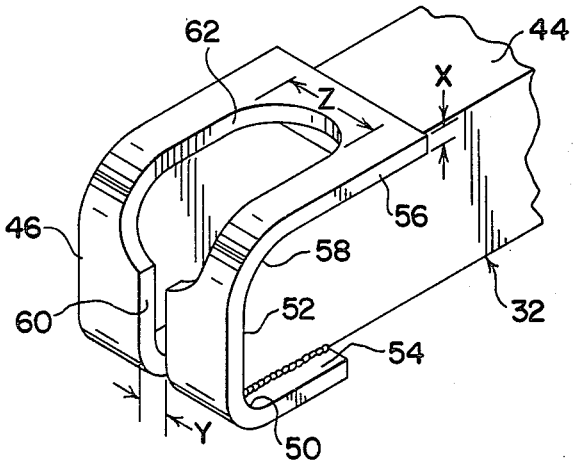
FIG. 2
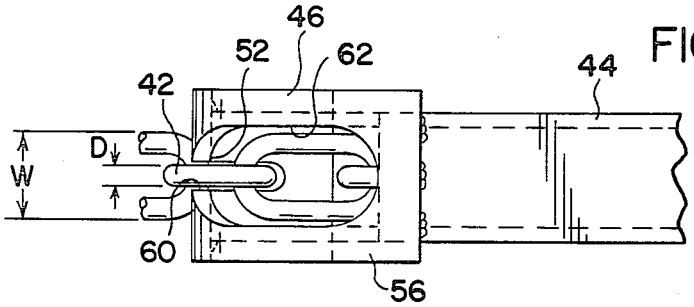
FIG. 3

LIFT ARM WITH IMPROVED CHAIN CONNECTOR

BACKGROUND OF THE INVENTION

The present invention relates to a plow blade lifted by a hydraulic cylinder and, more particularly, to an improved lift arm for securing a chain which raises and lowers the plow blade.

Particular applicability of the invention is derived from use in connection with a front mounted hydraulic lift assembly. Mounted on portions of a frame of a vehicle, the hydraulic lift assembly is controlled from within the operator cab. The plow blade is pivotably mounted at a front portion of the vehicle frame. Mounted above the vehicle frame is a hydraulic cylinder arrangement for controlling the raising and lowering of the plow blade. In order to effect movement of the plow blade, one end of the lift arm is pivotably connected to a frame member of the vehicle. Connected between the ends of the lift arm is a piston rod of the hydraulic cylinder. Generally, a link chain connects the plow blade to the outer free end of the lift arm.

In the past, many arrangements have been used to connect the chain to the pivoted lift arm. One of these arrangements involves a lift arm having a narrow, perpendicular open slot at its outermost end for receiving one link of the chain. This slot provides the sole connection between the chain and the lift arm. If rough surfaces were encountered by the plow blade, the rapid and abrupt upward movement of the blade could result in the chain becoming free from the open slot. With the chain disconnected, reassembly of the chain to the lift arm is required. Prior art attempts at restraining the chain from being released from the slot frequently result in complication of the assembly procedures of the chain to the lift arm.

Presently, the chain is connected to the lift arm by a chain link restrained within the narrow slot such that the connecting link is constantly perpendicular to the face of the lift arm. When the blade is raised or lowered, the angle of the chain relative to the lift arm is continuously changing. Raising and lowering the blade therefore causes movement between interconnected links of the chain and, more particularly, movement between the link which is secured in the slot of the lift arm and the next lower link.

Constant movement between the interconnected links of the chain results in wear of the link material. Excessive wear can eventually lead to weakening of a particular link in the chain. Replacement of the chain within the plow assembly presents an extensive problem. The link chain is generally connected to plow blades by welding the chain directly to a portion of the blade. If the chain is required to be replaced, as a result of weakening of a link, the old chain must be cut loose and a new chain welded to the blade.

SUMMARY OF THE INVENTION

The present invention relates to an improvement in a lift arm of a hydraulic plow arrangement which overcomes the disadvantages present in the prior art while allowing ease of assembly and operation.

In accordance with the present invention, there is provided a lift arm for use in a hydraulically operated plow blade assembly. The lift arm includes a chain receiving member at the free end thereof. Locking of a link of chain is permitted within an elongated slot in the outer surface of the chain receiving member. Connected with the elongated slot is an opening of a substantial size for passage of the chain therethrough.

The inner surface of the chain receiving member has an upwardly facing concave surface through the area which restrains the link of the chain. The concave surface of the chain receiving member assures that the chain constantly remains perpendicular to a chain engaging surface. Whether the blade is completely raised, completely lowered, or at any point therebetween the chain remains perpendicular to the chain engaging surface. Excessive wear between interconnected links of the chain is eliminated by maintaining the chain perpendicular to this chain engaging surface.

The primary object of the present invention is the provision of a lift arm for lifting a plow blade by a chain connected to the lift arm, which lift arm includes structure for reducing the inadvertent disconnecting of the chain from the arm during use.

Another object of the present invention is the provision of a lift arm for lifting of a plow blade by a chain connected to the lift arm, which lift arm includes an upwardly facing concave surface of a chain gripping member for maintaining a perpendicular relationship between the chain and the chain gripping member to reduce wear between successive chain links.

BRIEF DESCRIPTION OF THE DRAWINGS

These and other objects and advantages will become apparent from the following description taken together with the accompanying drawings in which:

FIG. 1 is a partial, pictorial view illustrating the preferred embodiment of the present invention and the environment to which it applies;

FIG. 2 is a partial perspective view illustrating a chain receiving member of a lift arm of the preferred embodiment of the present invention;

FIG. 3 is a top elevational view of the lift arm and a chain showing the preferred embodiment of the present invention;

DETAILED DESCRIPTION OF THE PREFERRED EMBODIMENT

Figure 4:
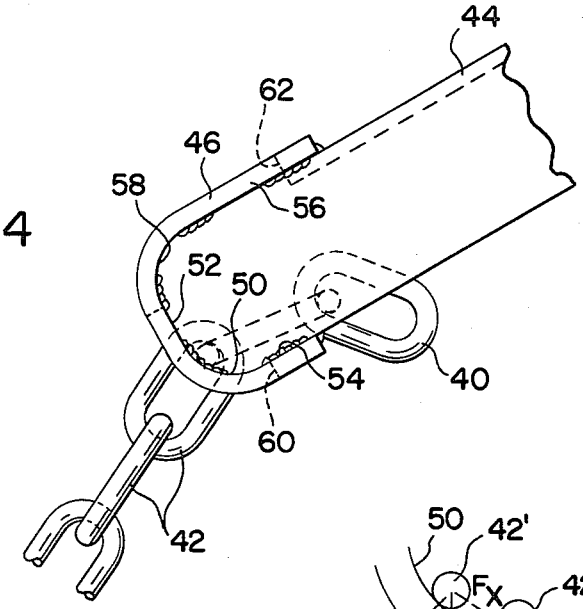
FIG. 4 is a side elevational view of the lift arm and chain showing the preferred embodiment of the present invention representing the positions of the chain and chain receiving member when the blade engages the roadway.

The present invention concerns an improved lifting arrangement for a plow blade carried by a vehicle. Shown in FIG. 1 is a front portion of a motor vehicle 10. Motor vehicle 10 includes a front bumper 12 connected to a frame 14 of the vehicle. A plow blade 20 is mounted to the front of motor vehicle 10 for clearing a roadway of snow, ice or other debris. Connecting plow blade 20 to motor vehicle 10 is an A-frame 22. At the motor vehicle, A-frame 22 is attached to frame 14 by pins 24 allowing relative pivotal motion. A-frame 22 is also attached to blade 20 by means of pins 26 allowing relative pivotal motion.

Secured to frame 14 in a vertical orientation above bumper 12 is a supporting frame 30. Pivotally connected to support frame 30 is one end of a lift arm 32 by a pin 34. A hydraulic cylinder device 36 is supported by support frame 30 between bumper 12 and lift arm 32. Lift arm 32 is connected to a piston rod 38 of hydraulic cylinder 36 near the center of lift arm 32.

Hydraulic cylinder 36 is operable from within motor vehicle 10 to raise and lower blade 20 relative to a roadway (not shown). Control means for angling blade 20 relative to the motor vehicle and roadway may also be provided by hydraulic cylinder 36. A chain 40 is connected between A-frame 22 and lift arm 32 for the purpose of raising and lowering blade 20. Chain 40 is preferably attached to A-frame 22 by means of welding or other permanent fastening. As so far described, this structure is similar to that disclosed in prior U.S. Pat. No. 3,706,144, the disclosure of which is incorporated by reference herein.

Attachment of chain 40 to lift arm 32 encompasses the objects of the present invention. Chain 40, connecting A-frame 22 to lift arm 32, includes a plurality of individual links 42, which are standard links having known dimensions. Any suitable link chain may be used to support blade 20. In the preferred embodiment of the invention, for illustration purposes only, a standard 5/16 proof-coil chain is used to illustrate the various dimensional relationships between the preferred embodiment of the invention and one of chain links 42. Chain link 42 has a diameter D (FIG. 3) which is approximately 11/32 inch. The width of chain link 42, designated W, is approximately 1-3/16 inches. Chain link 42 has a length designated L (FIG. 5) of approximately 1-3/4 inches. The inside opening of a somewhat standard chain link is approximately 1.1 inches.

Lift arm 32 (FIG. 1) includes an elongated body 44. Pivot pin 34 extends through one end of elongated body 44. Another end of elongated body 44 has a chain receiving member 46 permanently secured thereto. Chain receiving member 46 is a unitary structure having a thickness X (FIG. 2) substantially less than the length L of chain link 42. Elongated body 44 and chain receiving member 46 are permanently joined such as by welding.

Chain receiving member 46 includes an upwardly facing, concave surface 50 located at the bottom front corner of elongated member 44. Concave surface 50 provides a chain engaging surface which extends in a selected arcuate path in a generally vertical direction. Extending vertically from an upper edge of concave surface 50 is a first chain engaging surface 52. A second chain engaging surface 54 extends from a lower edge of concave surface 50 in a horizontal direction toward pivot pin 34 and away from blade 20. Chain receiving member 46 includes a top portion 56 which is generally parallel to second chain engaging surface 54. Top portion 56 of chain receiving member 46 is connected to first chain engaging surface 52 by an arcuate portion 58. Chain receiving member 46 is constructed as a unitary member through stamping or forming operations and is welded to the end of elongated member 44. While the shape of the outside surface of the chain receiving member is shown as being arcuate, this is not critical. The shape of the inside surface, concave surface 50, is important and must be maintained. Orientation of chain receiving member 46 relative to elongated body 44 results in top portion 56 being secured along the top of elongated body 44.

Chain receiving member 46 has a slot 60 extending therethrough at the center of its width parallel to the selected arcuate path of concave surface 50. Extending through concave surface 50 and portions of first 52 and second 54 chain engaging surfaces, slot 60 has a width Y (FIG. 2) slightly greater than thickness D of chain link 42. The depth of the slot upward from the bottom of elongated member 44 is at least equal to width W of the chain link. Slot 60 does not extend through any edges of chain receiving member 46.

Communicating with slot 60 is an opening 62, also centrally located within chain receiving member 46. Extending through arcuate portion 58 and portions of first chain engaging surface 52 and top portion 56, opening 62 has a width Z (FIG. 2) slightly greater than width W of chain link 42. Opening 62 does not extend through any edges of chain receiving member 46.

Figure 6:
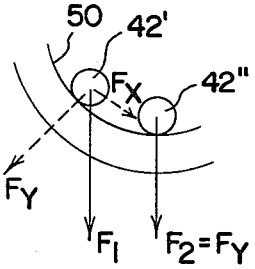

The inside surface of chain receiving member 46 and, more specifically, concave surface 50 provides a surface upon which chain link 42 of the chain binds and restrains the chain and blade 20. FIG. 6 illustrates the movement of chain link 42 relative to concave surface 50. If a chain link 42′ is located as shown in FIG. 6, a downward force $F_1$ exerted on chain link 42′ by blade 20 results in component forces $F_X$ along concave surface 50 and $F_Y$ perpendicular to the concave surface. The component of force $F_X$ along concave surface 50 causes chain link 42′ to move to the position shown at 42″. Movement of the chain link occurs until the component of force in the direction of concave surface 50 is extinguished. With the chain link as shown at 42″, the total force exerted upon the chain link, $F_2$, is equal to the perpendicular force $F_Y$. As a result of the shape of concave surface 50, a force exerted upon chain 40 causes the chain link to move relative to the concave surface until any component of force in the direction of the concave surface is extinguished. The chain link therefore adjusts for any force thereon by moving to a position along concave surface 50 having only a perpendicular force.

Chain 40 is connected to chain receiving member 46 by passing the chain through opening 62 and aligning a single chain link 42 in a vertical position within slot 60 as shown in FIG. 4. Any unused portion of chain 40 hangs downwardly through the elongated body from opening 62. Thickness X of chain receiving member 46 is sufficient to allow easy insertion of chain link 42. By way of example only, when using the above noted standard 5/16 proof-coil chain, slot 60 has a width Y of approximately 15/32 inch. Thickness X of chain receiving member 46 is approximately $\frac{3}{8}$ inch. Width Z of opening 62 is approximately 1-$\frac{3}{8}$ inches.

Figure 5:
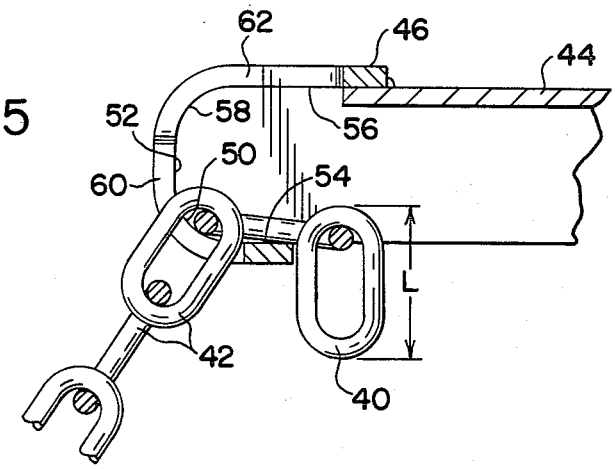
FIG. 5 is a cross-sectional view of the lift arm showing the preferred embodiment of the present invention illustrating the relationship of the chain and chain receiving member when the blade is completely lifted; and, FIG. 6 is a schematic illustration of a concave surface of the chain receiving member depicting forces exerted by the chain on the concave surface.

Concave surface 50 of chain receiving member 46 provides a surface upon which chain link 42 binds and restrains the chain and thus blade 20. As blade 20 is raised and lowered by operation of hydraulic cylinder 36, chain 40 slides relative to chain receiving member 46. FIG. 4 illustrates the relative positions of chain 40 and chain receiving member 46 when blade 20 is completely lowered. All chain links 42 are generally perpendicular to concave surface 50 of chain receiving member 46 at a point of contact. FIG. 5 illustrates the relative positions of chain 40 and chain receiving member 46 when blade 20 is completely lifted. All of chain links 42 are generally perpendicular to concave surface 50 of chain receiving member 46 at a different point of contact.

Inadvertent jumping of chain 40 from slot 60 is prevented by the presence of top portion 56 of chain receiving member 46. Once chain 40 has been inserted through opening 62 such that a chain link 42 rests vertically within slot 60, the presence of an immediately adjacent chain link 42 interconnected with the first chain link restrains the chain and thus blade 20 with respect to lift arm 32.

In accordance with the preferred embodiment of this invention, chain receiving member 46 is constructed in a manner restraining chain 40 within slot 60 with the chain remaining generally perpendicular to a point of contact with chain receiving member 46. This perpendicular relationship is maintained regardless of the relative positions of chain 40 and chain receiving member 46. As a result of the perpendicular relationship, the expectant useful life of chain 40 is increased by minimizing wear due to sliding engagement between interconnected chain links.

Having thus described the invention, the following is claimed:

1. In a lift arm for raising a plow blade from a roadway when said lift arm is pivoted upwardly by a hydraulic cylinder, said lift arm including an elongated body portion having an end for receiving a chain which chain extends in a selected direction from said blade and means for pivotally mounting said lift arm about an axis spaced from said chain receiving end, said chain to be used with said lift arm including a series of interconnected links each having a known length, a known thickness and a known width, and a chain receiving member secured to said chain receiving end, an improvement comprising: said chain receiving member having an upwardly facing generally concave chain engaging surface extending in a selected arcuate path in a generally vertical direction, said concave surface facing generally in a direction aligned with said selected direction of said chain, a slot extending through a portion of said concave surface in a direction generally parallel to said selected arcuate path, said slot having a width slightly greater than the thickness of said link, whereby one link of said chain can be restrained in said slot by said concave surface and remains generally perpendicular to said concave surface regardless of the relative positions of said chain and said concave surface, an opening in said elongated body portion between said chain receiving member and said means for pivotally mounting said lift arm, said opening having a width slightly greater than the width of said link, whereby said chain extends through said opening downwardly from said lift arm when the link is restrained in said slot.

2. A lift arm for raising and lowering a plow blade when said lift arm is pivoted vertically by a hydraulic cylinder, said lift arm having an elongated body portion with a chain receiving end, means for mounting said lift arm about an axis spaced from said chain receiving end for pivotal motion, and a chain receiving member secured to said chain receiving end, a chain to be used with said lift arm including a series of interconnected links each having a known length, a known thickness, and a known width, the lift arm comprising: an upwardly facing generally concave chain engaging surface of said chain receiving member extending in a selected arcuate path, a first chain engaging surface extending from one edge of said concave surface in a generally vertical direction, a second chain engaging surface extending from another edge of said concave surface in a generally horizontal direction away from said blade, said chain receiving member including a top portion generally parallel to said second chain engaging surface said top portion extending from said first chain engaging surface away from said blade, a slot extending through said concave surface and a portion of said first and second chain engaging surfaces in a direction generally parallel to said selected arcuate path, said slot having a width slightly greater than thickness of said link, and an opening in said first chain engaging surface communicating with said slot, said opening extending through a portion of said top portion, said opening having a width slightly greater than the width of said link, whereby said chain can be extended through said opening and one link restrained in said slot by said concave surface with said chain remaining generally perpendicular to said concave surface regardless of the relative positions of said chain and said concave surface.

3. The lift arm according to claim 2 wherein said opening has a length substantially greater than the length of said link.

* * * * *